US007784793B2

(12) United States Patent
Kemp

(10) Patent No.: US 7,784,793 B2
(45) Date of Patent: Aug. 31, 2010

(54) ROPING APPARATUS

(76) Inventor: Glen Kemp, 891 - 107th Street, North Battleford, SK (CA) S9A 1Y6

( * ) Notice: Subject to any disclaimer, the term of this patent is extended or adjusted under 35 U.S.C. 154(b) by 0 days.

(21) Appl. No.: 12/197,750

(22) Filed: Aug. 25, 2008

(65) Prior Publication Data

US 2009/0189352 A1 Jul. 30, 2009

(51) Int. Cl.
*A63B 69/00* (2006.01)
*G09B 9/00* (2006.01)

(52) U.S. Cl. ..... 273/343; 273/338; 119/839; 472/69

(58) Field of Classification Search ..... 273/338, 273/343, 407, 336, 382, 348; 119/839; 472/69
See application file for complete search history.

(56) References Cited

U.S. PATENT DOCUMENTS

| | | | | | |
|---|---|---|---|---|---|
| 3,066,939 | A | | 12/1962 | Sprout | |
| 3,974,799 | A | * | 8/1976 | Parsons | 273/336 |
| 4,136,874 | A | * | 1/1979 | McCord | 273/339 |
| 4,165,712 | A | * | 8/1979 | Crowley, Jr. | 119/174 |
| 4,203,233 | A | * | 5/1980 | Crane | 434/247 |
| 4,364,570 | A | | 12/1982 | Hallam | |
| 4,498,676 | A | * | 2/1985 | Runner | 273/336 |
| 4,640,515 | A | * | 2/1987 | Rhine | 273/339 |
| 4,981,302 | A | * | 1/1991 | Narramore | 273/339 |
| 5,009,432 | A | * | 4/1991 | Richard | 273/339 |
| 5,080,373 | A | * | 1/1992 | Jones | 273/338 |
| 5,192,210 | A | * | 3/1993 | Thomas et al. | 434/247 |
| 5,286,032 | A | * | 2/1994 | Spencer | 273/339 |
| 5,568,926 | A | * | 10/1996 | Kaptein | 273/359 |
| 5,709,386 | A | * | 1/1998 | Nelson | 273/370 |
| 6,497,411 | B1 | | 12/2002 | Nelson | |
| 6,629,695 | B2 | * | 10/2003 | Tisdell | 273/359 |
| 7,059,605 | B1 | * | 6/2006 | Hughes | 273/369 |
| 7,293,775 | B1 | * | 11/2007 | Donnelly | 273/359 |
| 7,430,990 | B1 | * | 10/2008 | Copenhaver | 119/839 |
| 2004/0101811 | A1 | * | 5/2004 | Gipson | 434/247 |
| 2005/0282128 | A1 | * | 12/2005 | Brinkerhoff et al. | 434/247 |
| 2006/0170163 | A1 | * | 8/2006 | Perkins | 273/359 |
| 2009/0014960 | A1 | * | 1/2009 | Brackens | 273/406 |

* cited by examiner

*Primary Examiner*—Mark S Graham
(74) *Attorney, Agent, or Firm*—Frost Brown Todd LLC

(57) ABSTRACT

A roping practice apparatus includes a base and at least one wheel rotatably mounted to the base about a horizontal wheel axis oriented transverse to the base and below the top surface of the base, the wheel defiling at least one slot extending from a rim of the wheel toward the wheel axis. The rim of the wheel extends above the top surface of the base. An upper portion defines a wheel well on a bottom surface thereof, and is configured such that the wheel extends upward into the wheel well. The upper portion is supported above the base such that a gap is formed between the upper portion and the base. The wheel is configured such that a selected object drawn through the gap enters the at least one slot on the wheel and causes the wheel to rotate. A retainer mechanism is operative to prevent the upper portion from moving upward away from the base.

28 Claims, 9 Drawing Sheets

ROPING APPARATUS

This invention is in the field of equipment for training and amusement and in particular a roping apparatus such as would be used by a calf and steer ropers for practice, or could be used for amusement purposes in homes, businesses and roping schools or an arcade or the like.

BACKGROUND

Calf roping is a sport where a rider on horseback chase a call throwing a loop of rope over the calf's head. Team calf roping is a sport where a pair of riders on horseback chase a calf or steer with one rider throwing a loop of rope over the calf's head and the other throwing a loop around one or both hind legs. While roping is a popular sport it is difficult to practice the skills required to successfully compete. Both the livestock being roped and the horses ridden to rope them are in limited supply, and require frequent rest. Repeatedly roping livestock over a short period can also injure the animal. A considerable fenced area is required as well for live training, and so it is essentially not practical to use live animals for extensive roping practice of the kind necessary to develop winning skills.

For that reason roping training and practice devices have been developed which provide a dummy calf's head to rope. The simplest of these are simply a head on a stake which can be inserted into a bale in a desired orientation for roping. A problem with these simple devices, and also with live animal training, is that the roper must approach the dummy or live calf to remove the loop after a successful throw. Thus roping training devices were developed that allowed the roper to pull the loop off the dummy after a successful throw by allowing the horns on the dummy to fold upward or rearward so that the loop slips over the horns and can be retrieved by the roper. Such devices are disclosed for example in U.S. Pat. Nos. 4,364,570 to Hallum, 3,066,939 to Sprout, and 6,497,411 to Nelson. These devices however do not realistically simulate an actual calf roping event where the loop is thrown over the calf's head and falls down its neck.

Western rodeo events have spawned devices designed for amusement and entertainment. For example the "mechanical bull" is a popular attraction at fairs, night clubs, and the like. A dummy bull is mounted on an activation mechanism which moves and turns the dummy to simulate an actual bull ride. The speed of movement can be varied and people ride the bull to the amusement of the spectators and themselves. It is contemplated that a calf roping training and practice device could be of such a design that same could similarly be used for amusement and entertainment.

SUMMARY OF THE INVENTION

It is an object of the present invention to provide a roping practice and amusement apparatus that overcomes problems in the prior art.

In a first embodiment the present invention provides an apparatus comprising a base having a front end, a rear end, and a top surface. A wheel is rotatably mounted to the base about a substantially horizontal wheel axis oriented transverse to the base and below the top surface of the base, the wheel defining at least one slot extending from a rim of the wheel toward the wheel axis. The wheel is mounted such that the rim of the wheel extends above the top surface of the base. An upper portion defines a wheel well on a bottom surface thereof, and is configured such that the the rim of the wheel extends upward into the wheel well. The upper portion is supported above the base such that a gap is formed between the bottom surface of the upper portion and the top surface of the base. The wheel is configured such that a selected object drawn through the gap enters the at least one slot on the wheel and causes the wheel to rotate. A retainer mechanism is operative to prevent the upper portion from moving upward away from the base.

In a second embodiment the present invention provides a roping practice apparatus comprising a base, and a plurality of spoked wheels rotatably mounted to the base about substantially parallel and horizontal wheel axes oriented transverse to the base and below the top surface of the base. Each spoked wheel defines a slot between adjacent radially extending spokes, and the spoked wheels are mounted such that the spokes extend above a top surface of the base. A head portion defines a plurality of wheel wells on a bottom surface thereof, and each spoked wheel extends upward into a corresponding wheel well. A well flange extends laterally from a first sidewall of each wheel well into the corresponding wheel well, and a spoke flange extends laterally from an outer end of each spoke toward the first sidewall of the corresponding wheel well such that the spoke flanges pass above the well flange. The head portion is supported above the base by inner surfaces of the wheel wells bearing against the outer ends of the spokes such that a gap is formed between the bottom surface of the head portion and the top surface of the base. The spoked wheels are configured such that a rope drawn through the gap enters a slot on each spoked wheel and causes each spoked wheel to rotate The apparatus of the present invention provides a roping practice and amusement device with an upper portion, such as a calf's head where the rope appears to pass directly through the calf's neck. The apparatus provides a realistic roping simulation for practicing by serious ropers, and the optics of the operation of the apparatus can provide entertainment and amusement for the general public as well.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
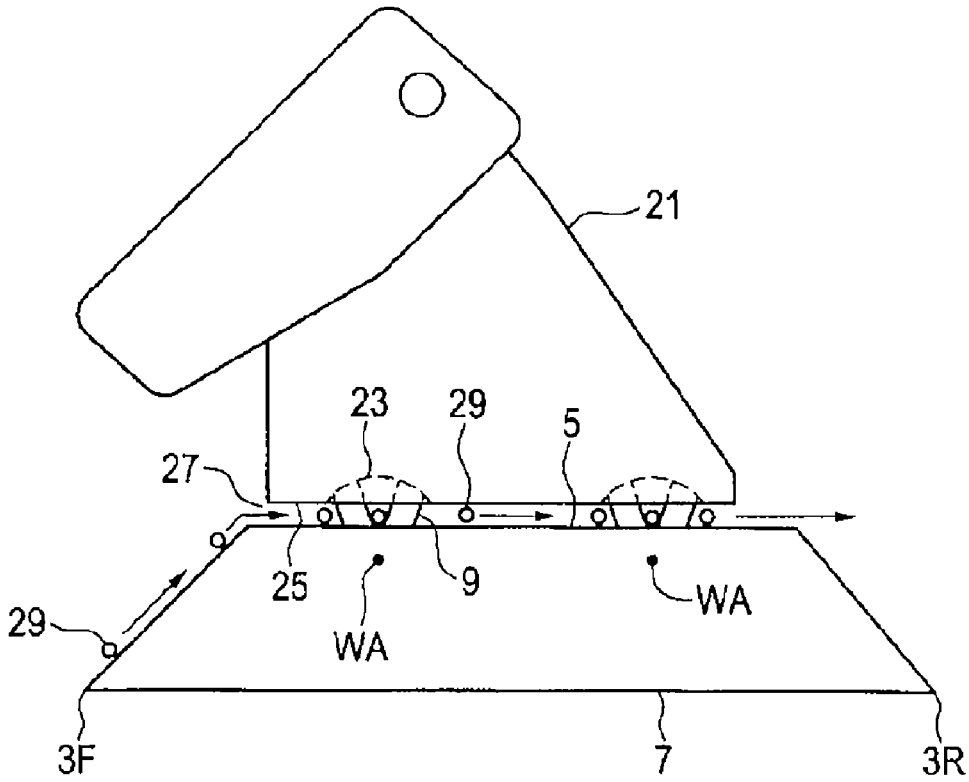
FIG. 1 is a side view of an embodiment of the apparatus of the present invention.
Figure 2:
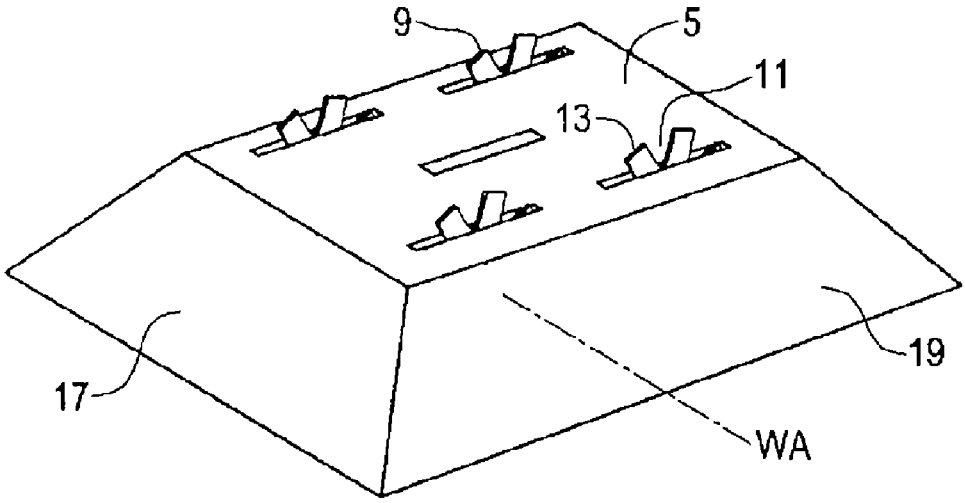
FIG. 2 is a perspective view of the base of the embodiment of FIG. 1 with the upper portion removed.

FIG. 1 illustrates an apparatus 1 of the present invention configured for roping practice. The apparatus 1 comprises a base 3, further illustrated in FIG. 2, having a front end 3F, a rear end 3R, a top surface 5, and a lower surface 7 adapted to rest on the ground or to rest on or mount to a support structure.

A plurality of wheels 9 are rotatably mounted to the base 3 about substantially parallel and horizontal wheel axes WA oriented transverse to the base 3 and below the top surface 5 of the base 3. The wheels 9 define slots 11 extending from a rim of the wheel 9 toward the wheel axis WA. In the illustrated apparatus the wheels 9 are spoked wheels with each spoked wheel 9 defining the slots 11 between adjacent radially extending spokes 13. The spoked wheels 9 are mounted such that the spokes 13 extend above the top surface 5 of the base 3. An alternate embodiment where the wheel defines a single slot is described below.

Figure 3:
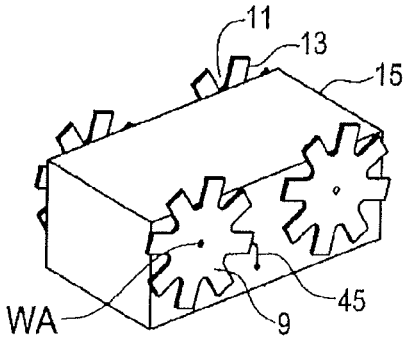
FIG. 3 is a perspective view of the base of FIG. 2 with the base cover removed to illustrate the frame and mounting of the spoked wheels.

The mounting of the spoked wheels 9 is shown in more detail in FIG. 3. In the illustrated embodiment of the apparatus 1 of the invention the spoked wheels 9 are mounted to a frame 15, and a base cover is placed over the frame 15 to provide the base 3 with the top surface 5, a front surface 17 sloping upward and rearward from the front end of the lower surface 7 of the base 3 to the front end of the top surface 5 of the base 3, and side surfaces 19 sloping upward and inward from the lower surface 7 to the top surface 5.

Figure 4:
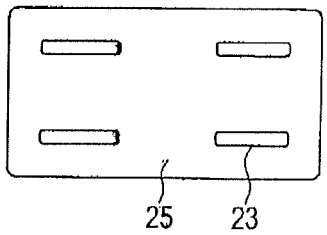
FIG. 4 is a bottom view of the upper portion of the embodiment of FIG. 1.

An upper portion 21 defines a plurality of wheel wells 23, as best seen in FIG. 4, a on a bottom surface 25 thereof, such that each spoked wheel 9 extends upward into a corresponding wheel well 23, as shown in FIG. 1. The upper portion 21 is supported above the base 3 by inner surfaces of the wheel wells 23 bearing against outer ends of the spokes 13 such that a gap 27 is formed between the bottom surface 25 of the upper portion 21 and the top surface 5 of the base 3. The illustrated apparatus 1 shows four spoked wheels 9 and corresponding wheel wells 23 such that the upper portion 21 is supported at each corner, however it is contemplated that other arrangements could also be used. In the illustrated embodiment the upper portion 21 is illustrated as the dummy head of a calf, however it is contemplated that the upper portion 21 could take virtually any shape that might be desired for a given situation, for example the top end of a post.

Thus a roper throws a loop of rope 29 over the head, upper portion 21, from the rear, in a like manner to actual calf roping, and same may fall to the ground surrounding the base 3. As the roper pulls rearward the rope 29 will slide up the front and side surfaces 17, 19 to the top surface 5 of the base 3 and into the gap 27. As illustrated in FIG. 1, as the rope 29 is drawn through the gap 27 from the front end 3F of the base 3 toward the rear end 3R the rope enters a slot 11 on each spoked wheel 9 and causes each wheel 9 to rotate and allow the rope to move rearward through the gap 27 until the rope 29 is clear of the spokes 13. It is contemplated that in other configurations of the apparatus 1, instead of a rope, twine, or the like, a different selected object properly configured, could be passed through the gap. For example in a magic trick a wand or rod could be passed through the gap 27.

For smooth operation, the inner surfaces of the wheel wells 23 substantially define a circle with a diameter substantially equal to an outside diameter of the spoked wheels 9.

In the illustrated embodiment, the outer ends of the spokes 13 are flat and so approximate a circle to a sufficient degree, and the ends could also be rounded to more closely conform to a circle. Thus the ends of the spokes 13 pass along the inner surfaces of the wheel wells, with one spoke entering the wheel well 23 as another spoke 13 rotates out of the wheel well 23 and thus maintaining the head portion above the base 3 as the rope 29, located in the slots 11, moves under the upper portion 21 through the gap 27 and out the rear end of the gap 27 where the rope is free for the roper to throw again.

Figure 8:
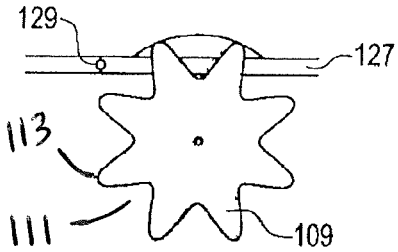
FIG. 8 is a side view of an alternate spoked wheel.
Figure 9:
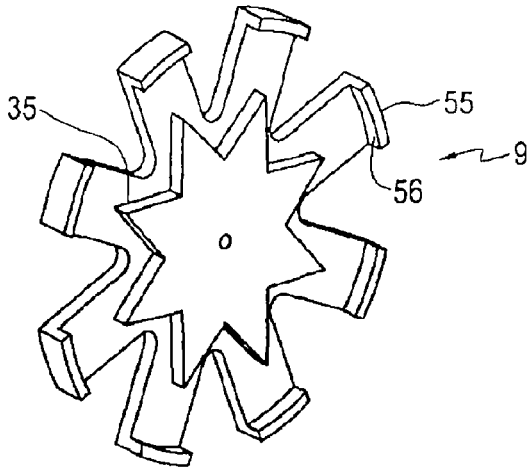
FIG. 9 is a perspective view of a spoked wheel with spoke flanges.

The illustrated embodiment of the apparatus 1 includes spoked wheels 9 with wide outer ends. FIG. 8 illustrates an alternate spoked wheel 109 having spokes 113 with roundly pointed outer ends. It is contemplated that the wheel 109 with pointed spokes 113 will allow a rope 129 to enter a wedge shaped slot 111 on one side or the other of the rounded and pointed end without jamming, however the reduced surface area at the end of the spoke 113 bearing against the inner surface of the wheel wells can increase the force required to turn the spoked wheel 109, and hamper the smooth rotation of the wheel 109 as it bears the weight of the upper portion.

Figure 5:
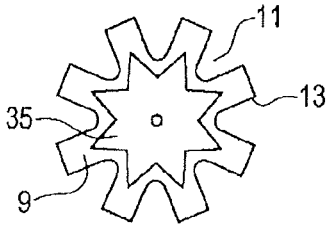
FIG. 5 is a side view of a spoked wheel and a star shaped member attached thereto to provide a spoked wheel orientation mechanism.
Figure 6:
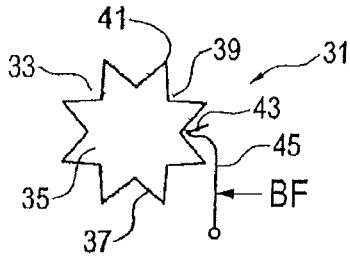
FIG. 6 is a side view of the star shaped member of FIG. 5 showing the stop member of the spoked wheel orientation mechanism.
Figure 7:
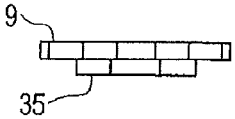
FIG. 7 is a top view of the spoked wheel and star shaped member of FIG. 5.

The spoked wheel 9 of FIG. 1 has a wide outer end to increase the bearing surface, and so a spoked wheel orientation mechanism 31, as illustrated in FIGS. 5-7 is provided to stop each spoked wheel 9 at a location wherein an open end of one of the slots 11 on each spoked wheel 9 is substantially aligned with the gap 27 to receive a rope 29 entering the front of the gap 27 so that the rope 29 smoothly enters a slot 11 and rotates the wheel 9 as it moves in the slot 11 through the gap 27.

The illustrated spoked wheel orientation mechanism 31 comprises a plurality of notches 33 on each spoked wheel 9, each notch 33 corresponding to a slot 11 on the spoked wheel 9. In the illustrated embodiment, the notches 33 are provided by a star shaped member 35 attached to the inner face of the spoked wheel 9 such that the star shaped member 35 has the same rotational axis as the spoked wheel 9. On the perimeter of the star shaped member 35, each notch 33 includes walls 37 sloping toward each other from an outer end 41 of the notch 33 to a bottom end 39 of the notch, and the outer ends of the walls 37 intersect.

A stop member 43 is mounted on the base 3 and biased toward the bottom end 39 of the notches 33. The stop member 43 bears against the sloped walls 37 and thus urges the star shaped member 35, and attached spoked wheel 9, to a position where the stop member 43 is at the bottom end 39 of a notch 33. In the illustrated embodiment the stop member 43 is mounted on the end of an arm 45 that is biased toward the bottom end 39 of the notches 33 by a spring or the like exerting a bias force BF.

The stop member 43 and notches 33 are configured such that as each spoked wheel 9 rotates, a corresponding stop member 43 moves into and out of the notches 33, and such that when the stop member 43 is at the bottom end of any notch 33 an open end of a slot 11 on the spoked wheel 9 is aligned with the gap 27.

When a loop of rope is thrown from the rear the rope will contact the upper portion 21. If the throw is successful the back of the loop will often contact the upper portion 21, and if the throw is unsuccessful generally there will be some contact between the rope and the upper portion, and thus some force exerted on the upper portion 21 in a generally forward direction. A retainer mechanism is therefore provided and is operative to prevent the upper portion 21 from moving upward away from the base 3.

FIGS. 9-12 illustrate a retainer mechanism provided by a well flange 53 extending laterally from one side wall of each wheel well 23, and spoke flanges 55 extending laterally from the outer ends of the spokes 13 of the spoked wheels 9. The spokes 13 pass through the wheel wells 23 in the spaces 57 between the outer ends of the well flanges 53 and the opposite side walls of the wheel wells 23, while the spoke flanges 55 extend laterally above the well flanges 53. Given the illustrated configuration of the spokes 13 and flanges 53 and 55, there is at all times during rotation of the spoked wheel 9 at least a portion of a spoke flange 55 above each well flange 53, such that if an upward force is exerted on the upper portion 21, the lower surface 56 of the spoke flange 55 will contact the upper surface 54 of the well flange 53, and prevent the upper portion 21 from moving away from the base to which the spoked wheels 9 are mounted.

Figure 13:
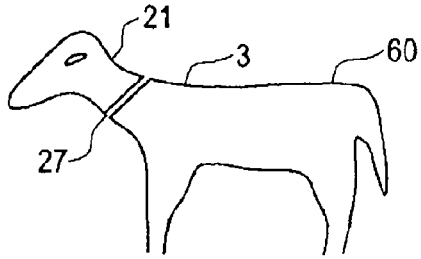
FIG. 13 is a schematic side view of a simulated calf with the gap between the upper portion and base oriented at an upward angle.

The retainer mechanism of FIGS. 9-12 secures tile upper portion 21 to the base 3 at all times and thus allows the upper portion 21 and base 3 to be oriented at an angle as illustrated in FIG. 13 such that the gap 27 slopes upward from a front end thereof to a rear end thereof, and allows, as illustrated, for simulating an actual calf 60 more realistically than an embodiment such as that illustrated in FIG. 1 where the gap is substantially horizontal, such as would be preferred where the upper portion 21 is weighted and balanced to resist being dislodged from the spoked wheels, without a retainer mechanism. It is contemplated that the gap 27 could also be curved instead of straight as illustrated, and oriented at virtually any angle, since the retainer mechanism secures the upper portion 21 to the base 3 at all times. In addition the illustrated retainer mechanism of FIGS. 9-12 would allow the base to be mounted on a moving mechanism, such as to simulate the running and/or bobbing up and down motion of a real calf.

In addition, a rope can pass through the gap 27 from the front toward the rear or from the rear towards the front thus allowing a roper to throw the rope from either the front or rear of the upper portion.

The illustrated well flanges 53 and spoke flanges 55 are configured such that lower surfaces 56 of the spoke flanges 55 and upper surfaces 54 of the well flanges 53 are arced with a radius having a center located substantially at the wheel axis of the spoked wheel 9 to provide smoother operation. A star shaped member 35 for orienting the spoked wheel as discussed above can be attached to the spoked wheel 9.

Figure 10:
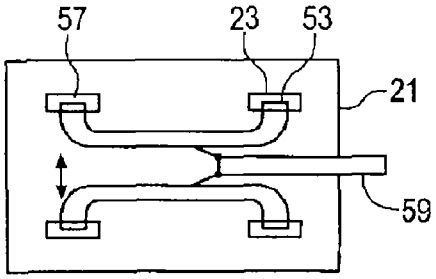
FIG. 10 is a schematic bottom view of the upper portion showing the wheel wells and well flanges, and a mechanism to retract the well flanges to release or install the spoked wheels.
Figure 11:
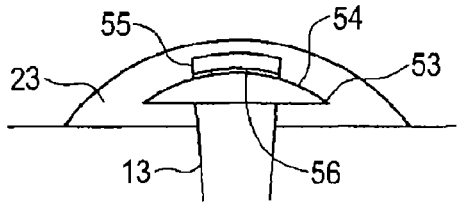
FIG. 11 is a schematic cut away side view of a spoked wheel flange in the wheel well.
Figure 12:
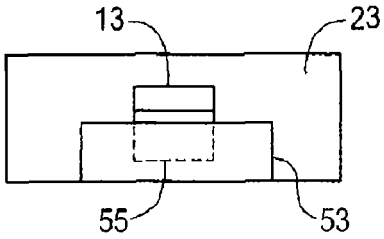
FIG. 12 is a schematic bottom view of the spoked wheel and wheel well of FIG. 11.

The well flanges 53 are retractable to allow the spoked wheel 9 to be removed from the wheel well 23. FIG. 10 schematically illustrates a handle 59 operative to move the well flanges 53 into and out of the wheel wells 23.

Figure 14:
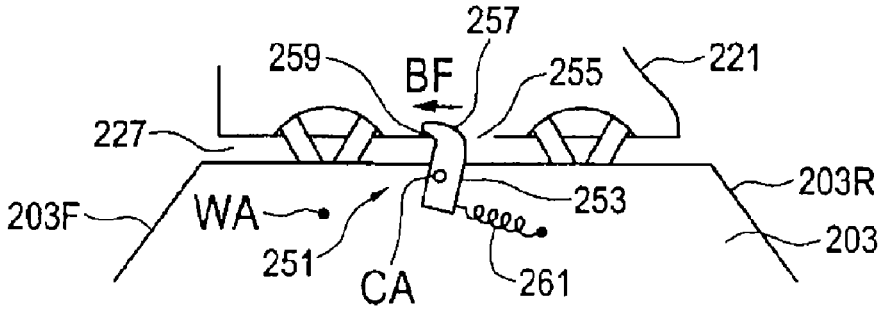
FIG. 14 is a schematic side view of a retainer mechanism for securing the upper portion to the base.
Figure 15:
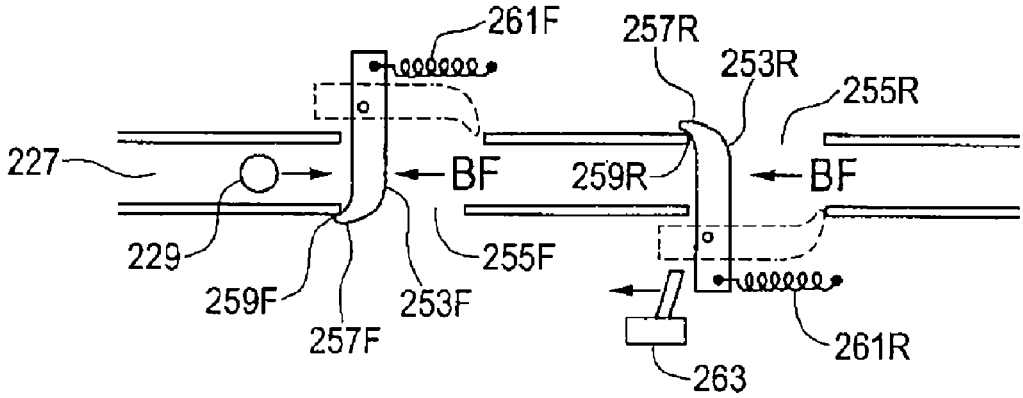
FIG. 15 is a schematic side view showing a retainer mechanism with front and rear catch members.

An alternate retainer mechanism is illustrated in FIGS. 14 and 15. The retainer mechanism is configured to release when a rope 229 is drawn through the gap 227 from the front end 203F of the base 203 toward the rear end 203R thereof. The illustrated retainer mechanism 251 comprises a catch member 253 pivotally mounted to the base 203 about a catch axis CA oriented substantially parallel to the wheel axes WA. A catch hole 255 is defined in the bottom surface 225 of the upper portion 221. The catch member 253 and catch hole 255 are configured such that a catching end 257 of the catch member 253 engages a lip 259 of the catch hole 255 when the catching member 253 is in an engaged position as illustrated in FIG. 14.

A bias element, illustrated as spring 261, is operative to urge the catch member 253 in a forward direction toward the engaged position such that when a rope 229 is drawn through the gap 227 the rope 229 forces the catch member 253 rearward out of the engaged position and pushes the catch member 253 into an open position substantially out of the gap 227, as illustrated by the broken lines in FIG. 15, to allow the rope 229 to pass through the gap 227.

FIG. 15 illustrates an embodiment comprising a front catch member 253F pivotally mounted to the upper portion and a front catch hole 255F defined in the base and configured such that a catching end 257F of the catch member 253F engages a lip 259F of the catch hole 255F when the front catching member is in the engaged position, and a front element 261F operative to urge the front catch member 253F into the engaged position.

A rear catch member 253R is pivotally mounted to the base 203 rearward of the front catch member 253F, and a rear catch hole 255R defined in the upper portion and configured such that a catching end 257R of the rear catch member 253R engages a lip 259R of the catch hole 255R when the rear catching member 253R is in an engaged position, and a rear bias element 261R operative to urge the rear catch member 253R into the engaged position.

As the rope 229 is drawn rearward through the gap 227 the rope 229 forces the front catch member 253F rearward out of the engaged position and into an open position substantially out of the gap 227, as illustrated by the broken lines, to allow the rope 229 to pass rearward through the gap 227 past the catching end 257F of the front catch member. The front bias element 261F forces the front catch member 253F back into the engaged position when the rope 229 has moved past the catching end 257F of the front catch member 253F. The rope 229 then contacts the rear catch member 253R and forces the rear catch member 253R rearward out of the engaged position and into an open position substantially out of the gap 227, as illustrated by the broken lines, to allow the rope 229 to pass rearward through the gap 227 past the catching end 257R of the rear catch member 253R.

FIG. 15 also illustrates a stroke counter 263 operative to count and record each time a rope passes through the gap 227. Thus a roper can easily keep track of the number of practice throws made. Where the apparatus is used for paid amusement or entertainment similar to a pool or shuffleboard game, the counter allows the owner to keep track of the number of throws made, and charge accordingly if desired.

Thus in the embodiment of FIG. 15 one of the front and rear catch members 253F, 253R, is engaged, substantially at all times depending on the speed with which the rope is pulled through the gap 227. If the rope 229 is pulled through very quickly there may be a short period when the rear catch member 253R is disengaged before the front catch member 253F returns to the engaged position. It is contemplated that a third catch member could be added if desired to provide front, middle, and rear catch members such that one would always be in the engaged position.

Figure 16:
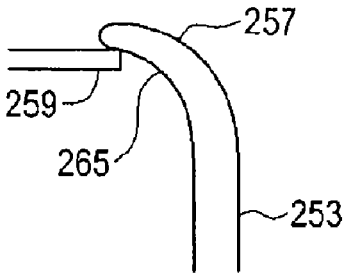
FIG. 16 is detail side view of the catching end of the catch member of the catching mechanism of FIG. 14.

In order that the rope 229 can pass over the catching end 257 of the catch member 253 it is necessary to somewhat round the transition 265 between the catch member 253 and the catching end 257, as illustrated in FIG. 16. As the rope moves rearward it bears against the sloped transition 265 and exerts a force on the catch member 253 to push it toward the open position. The lip 259 is thus not so securely engaged as it would be if the transition was a right angle, or at least closer to a right angle.

Figure 17:
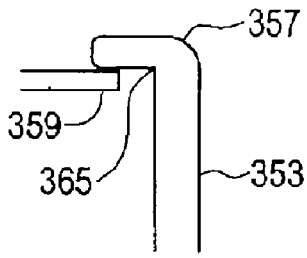
FIG. 17 is detail side view of the catching end of a catch member that is inoperative to allow the rope to pass through the gap.

FIG. 17 illustrates an alternate embodiment of a catch member 353 where the transition 365 to the catching end 357 is at a right angle. It can be seen that the catching end 357 more securely engages the lip 359 of the corresponding catch hole. It can be seen however that a rope would be likely to be caught in the transition 365, and thus not be able to pass through the gap as required.

Figure 18:
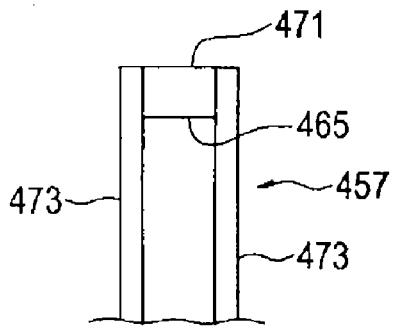
FIG. 18 is a front view of an alternate catch member.
Figure 19:
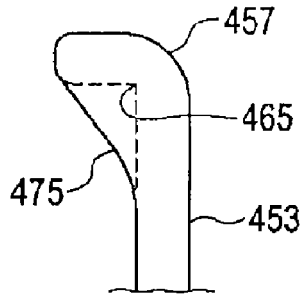
FIG. 19 is a side view of the catch member of FIG. 18.
Figure 20:
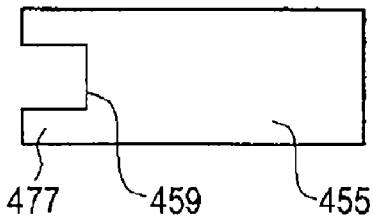
FIG. 20 is a plan view of a catch hole for use with the catch member of FIG. 18.

FIGS. 18-20 illustrate a catch member 453 with a catching end 457 that includes an inner portion 471 configured to engage the lip 459 of a catch hole 455. The inner portion 471 is configured substantially the same as the catching end 357 of the catch member with a right angle transition 365 illustrated in FIG. 16. Right and left outer portions 473 extend past the inner portion 471 on each side thereof. The outer portions 473 are configured to facilitate a rope passing over the catching end 457. The outer portions 473 include a sloped and rounded transition 475 that will not catch on the rope, and that keep the rope away from the inner portion 471 so the rope will not catch on it.

The corresponding catch hole 455, shown in FIG. 19, includes grooves 477 on each side of the lip 459. The grooves 477 are configured to allow the outer portions 473 to enter the catch hole through the grooves 477 on each side of the lip 459 so that the inner portion 471 can squarely engage the lip 459.

Figure 21:
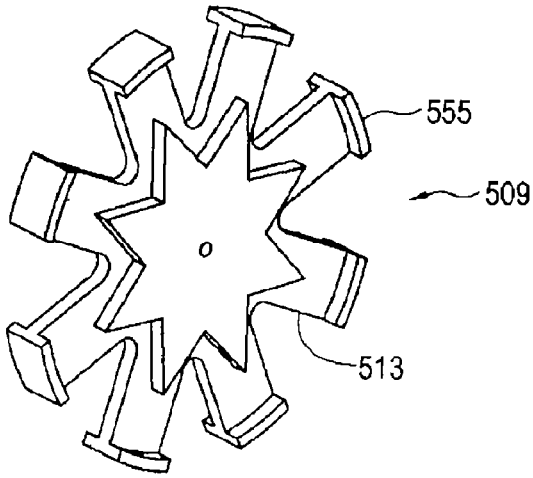
FIG. 21 is a perspective view of an alternate spoked wheel with spoke flanges.
Figure 22:
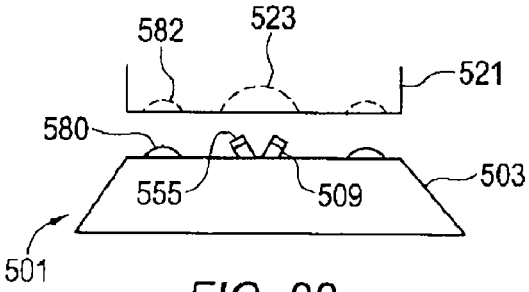
FIG. 22 is a schematic side view showing an alternate embodiment of the apparatus of the present invention using the spoked wheel of FIG. 21.

FIG. 21 illustrates a spoked wheel 509 for use with an alternate embodiment of the apparatus 501 of the present invention illustrated in FIG. 22 where the upper portion 521 is supported above the base 503 by a plurality of rounded lugs 580 protruding from the base 503 into a corresponding plurality of recesses 582 defined in the upper portion 521. The rounded lugs 580 could also instead protruding from the upper portion 521 into a corresponding plurality of recesses 582 defined in the base 503.

Figure 24:
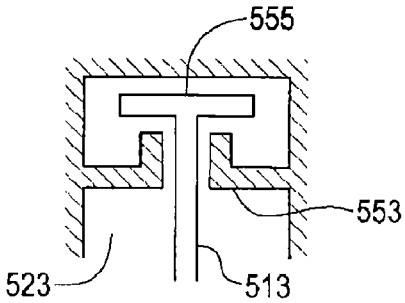
FIG. 24 is a schematic sectional view showing the configuration of the spoked wheel flanges and well flanges of the embodiment of FIG. 22.

The spoked wheel 509 includes spoke flanges 555 that extend laterally from the outer ends of the spokes 513 in both directions. The corresponding wheel well 523 includes well flanges 553 extending inward from each inner wall thereof as schematically illustrated in FIG. 24 such that the spoke flanges 555 are above the well flanges 553 on each side of the spokes 513.

Figure 23:
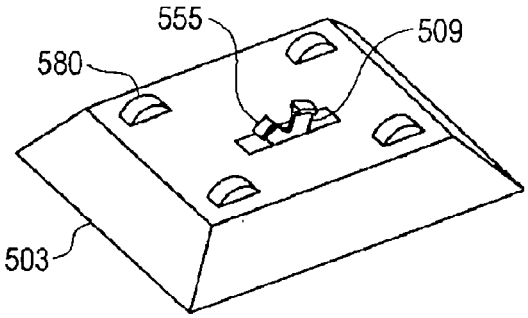
FIG. 23 is a perspective view of the base of the apparatus of FIG. 22.

The rounded lugs 580 are located on each corner of the base 503 as illustrated in FIG. 23 and the recesses are correspondingly located on the upper portion 521. Thus as the selected object, such as a rope passes through the gap between the upper portion 521 and the base 503 the upper portion rocks upward at the front to allow the rope to pass between the top of the lugs 580 at the front of the base 503 and the bottom surface of the upper portion 521, and then passes through the spoked wheel 513 as described above, and then similarly the upper portion rocks upward at the rear to allow the rope to pass out of the apparatus 501.

The weight of the upper portion 521 will maintain the lugs 580 on the base 503 engaged in the recesses 582 in the upper portion 521. It is contemplated as well that the recesses 582 and lugs 580 could include magnets to more firmly maintain the engagement, while at the same time allowing the rope to break the magnetic engagement and pass through.

It is also contemplated that the retainer mechanism could be provided by magnets either on the end of the spokes, or simply attracting each other across the gap between the base and the upper portion, or with like arrangements.

Figure 25:
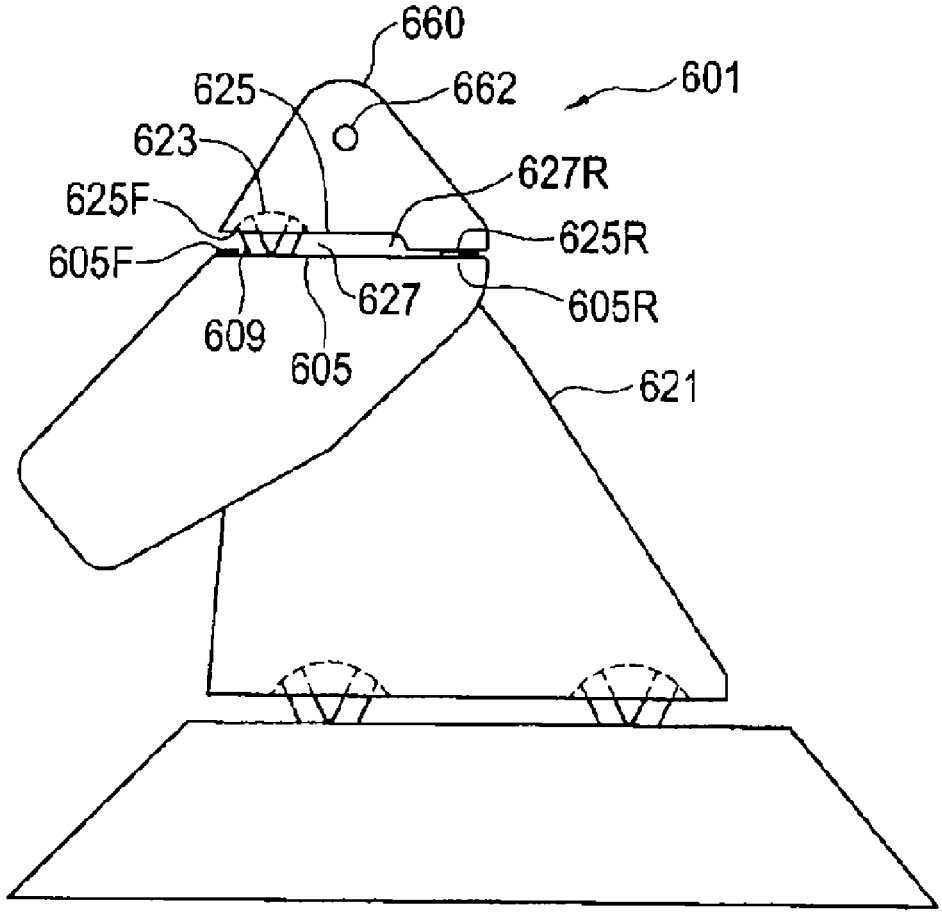
FIG. 25 is a schematic side view of a further alternate embodiment of the apparatus of the present invention including a horn portion whereby a user can practice roping the head or horns of a calf.

FIG. 25 schematically illustrates an apparatus 601 of the invention comprising a horn portion 660 mounted above the head portion 621. The user of this apparatus 601 can practice roping both the head and the horns of a calf.

The horn portion 660 comprises horn members 662 extending laterally from each side of the horn portion 660. Right and left spoked wheels 609 with spoke flanges as described above extend upward from a forward portion 605F of a top surface 605 of the head portion 621. Corresponding right and left wheel wells 623 with well flanges as described above are defined in corresponding forward portions 625F of the bottom surface 625 of the horn portion 660. Thus the front end of the horn portion 660 is supported above the head portion 621 by an inner surface of the right and left wheel wells 623 bearing against outer ends of the spokes of the right and left spoked wheels 609 such that a gap 627 is formed between forward portions 625F of the the bottom surface 625 of the horn portion 660 and the top surface 605 of the head portion 621. The rear portion 625R of the bottom surface 625 of the horn portion 660 rests on a rear portion 605R of the top surface 605 of the head portion 621. As a rope moves rearward through the gap 627 to a sloped rear end 627R of the gap 627 the rope causes the rear portion of the horn portion 660 to move upward off the top surface 605 of the head portion 621 to allow the rope to move rearward and away from the apparatus 601.

Figure 26:
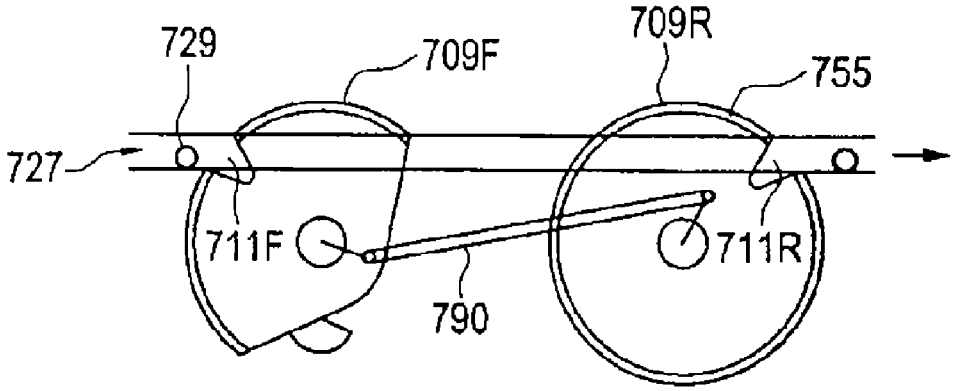
FIGS. 26 and 27 schematically illustrate an alternate embodiment where front and rear wheels are linked by a tie rod.
Figure 27:
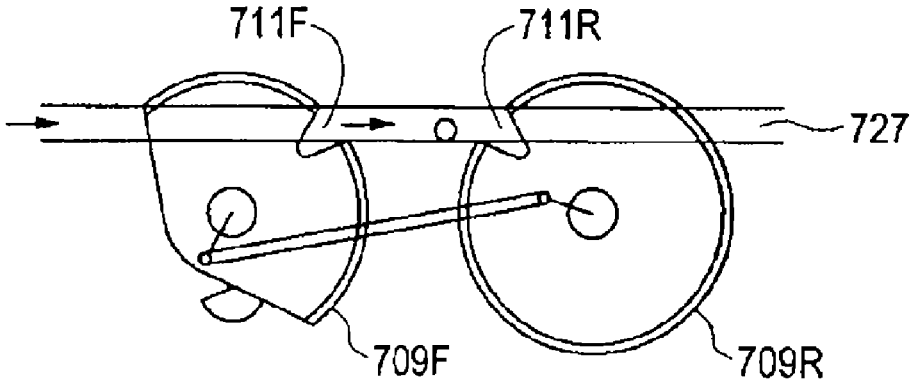

FIGS. 26 and 27 schematically illustrate an alternate apparatus with a front wheel 709F defining a front slot 711F and a rear wheel 709R defining a rear slot 711R. In a first position illustrated in FIG. 26, an open end of the front slot 711F is substantially aligned with the gap 727 at a front portion of the gap 727 to receive the selected object 729, such as a rope or wand, and an open end of the rear slot 711R is substantially aligned with the gap 727 at a rear portion of the gap 727 to allow the selected object 729 to move rearward away from the apparatus.

In a second position, illustrated in FIG. 27, the open end of the front slot 711F is substantially aligned with the gap 727 at a middle portion of the gap 727 to allow the selected object 729 to move rearward through the gap 727 and an open end of the rear slot 711R is substantially aligned with the gap 727 at the middle portion of the gap 727 adjacent to the open end of the front slot 711F to receive the selected object 729 as it moves rearward out of the open end of the front slot 711F.

The front and rear wheels 709F, 709R, are linked such that as the front wheel 709F rotates from the first position to the second position in response to the selected object 729 moving rearward in the front slot 711F through the gap 727 the rear wheel 709R rotates from the first position to the second position, and as the selected object 729 enters the rear slot 711R and moves rearward through the gap 727 the front and rear wheels 709F, 709R, rotate to the first position, where the wheels are again in position to receive another selected object moving rearward through the gap 727.

In the apparatus of FIGS. 26 and 27 the front and rear wheels 709F, 709R are linked by a tie rod 790 such that rotation of one of the wheels causes rotation of the other. It can be seen that rather than a full wheel, in the apparatus of FIGS. 26 and 27 the wheels can comprise only a partial circular portion as illustrated by the front wheel 709F. The upper portion is retained on the base by wheel flanges 755 on the outer rims of the front and rear wheels 709F, 709R configured to cooperate with well flanges as described above.

Figure 28:
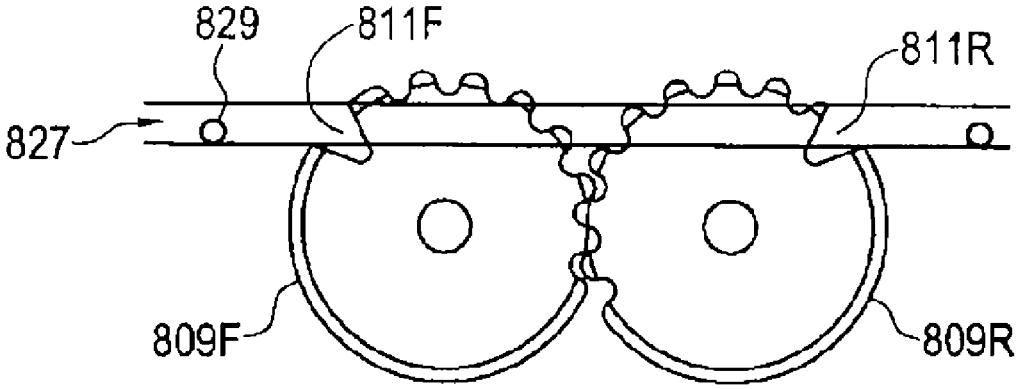
FIGS. 28 and 29 schematically illustrate a further alternate embodiment where front and rear wheels are linked by meshing gears.
Figure 29:
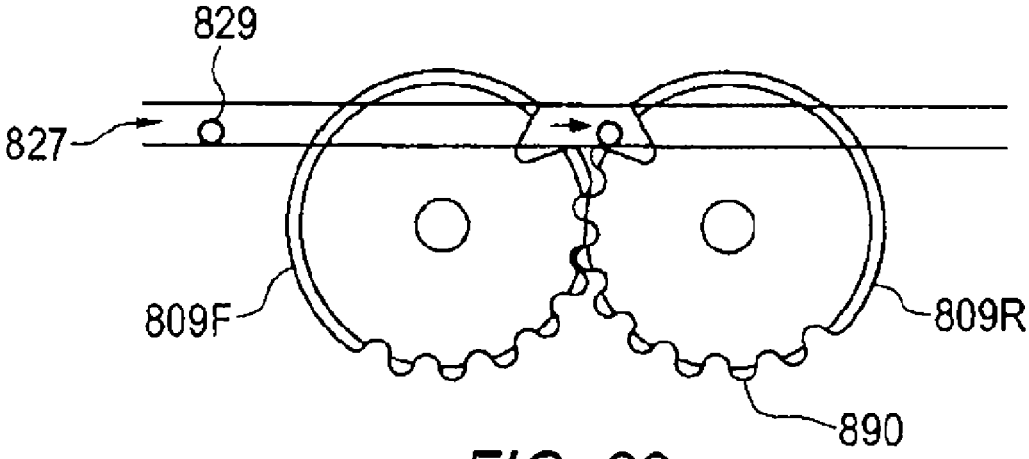

FIGS. 28 and 29 schematically illustrate a further alternative embodiment where the front and rear wheels 809F, 809R are linked by meshing gears 890 defined in outer rims of the front and rear wheels 809F, 809R such that rotation of one of the wheels causes rotation of the other. Thus when the wheels 809F, 809R are in the first position illustrated in FIG. 28 a selected object 829 moves into the front slot 811F and as it moves rearward through the gap 827 the wheels 809F, 809R rotate to the second position illustrated in FIG. 29, and as the selected object 829 moves into the rear slot 811R and continues rearward the wheels 809F, 809R rotate to the First position illustrated in FIG. 28 and the selected object 829 can move away from the apparatus.

While in the embodiment of FIGS. 14 and 15 the selected object, be it a rope, wand, or the like, must move from the front to the rear in order to release the retainer mechanism 251, in the embodiments of FIGS. 1, 21, and 26-29 it can be seen that the selected object can move in either direction through the gap. For embodiments for roping practice the rope will move from front to rear and it is not contemplated that any need will arise for moving the rope from the rear to the front. However where the embodiment is for use with a wand it may be desired to move the wand backward and forward through the gap, and appropriate retaining mechanisms will be used to allow that.

Thus the present invention provides a calf roping practice or entertainment device that is easy to use and provides a realistic roping experience. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An roping apparatus comprising:

a base having a front end, a rear end, and a top surface;

a wheel rotatably mounted to the base about a substantially horizontal wheel axis oriented transverse to the base and below the top surface of the base, the wheel defining at least one slot extending from a rim of the wheel toward the wheel axis;

wherein the wheel is mounted such that the rim of the wheel extends above the top surface of the base;

an upper portion roping target defining a wheel well on a bottom surface thereof, and configured such that the rim of the wheel extends upward into the wheel well;

wherein the upper portion is supported above the base such that a gap is formed between the bottom surface of the upper portion and the top surface of the base;

wherein the wheel is configured such that a selected object drawn through the gap enters the at least one slot on the wheel and causes the wheel to rotate; and a retainer mechanism operative to prevent the upper portion from moving upward away from the base.

2. The apparatus of claim 1 wherein the retainer mechanism is provided by a well flange extending laterally from a side wall of the wheel well, and a rim flange extending laterally from the rim of the wheel, wherein the rim flange extends laterally above the well flange as the wheel rotates.

3. The apparatus or claim 2 wherein the well flange and rim flange are configured such that a lower surface of the rim flange and an upper surface of the well flange are arced with a radius having a center located substantially at the wheel axis of the wheel.

4. The apparatus of claim 2 wherein the well flange is retractable such that the wheel can be removed from the at least one wheel well.

5. The apparatus of claim 2 wherein the bottom surface of the upper portion and the top surface of the base are oriented such that the gap slopes upward from a front end thereof to a rear end thereof.

6. The apparatus of claim 2 wherein the upper portion is supported above the base by an inner surface of the wheel well bearing against the rim of the wheel.

7. The apparatus of claim 6 comprising right and left wheels and wheel wells located in corresponding forward portions of the base and tipper portion wherein a front end of the upper portion is supported above the base by an inner surface of the right and left wheel wells bearing against the corresponding rims of the right and left wheels such that the gap is formed between forward portions of the bottom surface of the upper portion and the top surface of the base, and where a rear portion of the bottom surface of the upper portion rests on a rear portion of the top surface or the base; wherein as the selected object moves rearward through the gap to a sloped rear end of the gap the selected object causes the rear portion of the upper portion to move upward off the top surface of the base to allow the selected object to move rearward and away from the apparatus.

8. The apparatus of claim 2 wherein the upper portion is supported above the base by a plurality of rounded lugs protruding from one of the base and the upper portion into a corresponding plurality of recesses defined in the other of the base and the upper portion.

9. The apparatus of claim 1 wherein the retainer mechanism comprises:

a catch member pivotally mounted to one of the base and the upper portion about a catch axis substantially parallel to the wheel axes;

a catch hole defined in the other of the base and the upper portion and configured such that a catching end of the catch member engages a lip of the catch hole when the catching member is in an engaged position;

a bias element operative to urge the catch member toward the engaged position such that when the selected object is drawn through the gap the selected object forces the catch member out of the engaged position and pushes the catch member into an open position substantially out of the gap to allow the selected object to pass through the gap.

10. The apparatus of claim 9 comprising front and rear catch members and corresponding front and rear catch holes configured such that as the selected object moves rearward through the gap, the front catch member moves from the open position to the engaged position before the selected object forces the rear catch member out of the engaged position.

11. The apparatus of claim 9 wherein the catching end of the catch member includes an inner portion configured to engage the lip and right and left outer portions extending past the inner portion on each side thereof, the outer portions configured to facilitate the selected object passing over the catching end, and wherein the catch hole includes grooves on each side of the lip, the grooves configured to allow the outer portions of the catching end to enter the catch hole.

12. The apparatus of claim 9 wherein the upper portion is supported above the base by an inner surface of the wheel well bearing against the rim of the wheel.

13. The apparatus of claim 1 wherein the retainer mechanism comprises a magnet.

14. The apparatus of claim 1 comprising a plurality of spoked wheels and a plurality of slots on each spoked wheel, and further comprising a spoked wheel orientation mechanism operative to stop each spoked wheel at a location wherein an open end of a slot on each spoked wheel is substantially aligned with the gap to receive the selected object.

15. The apparatus of claim 14 wherein the spoked wheel orientation mechanism comprises:

a plurality of notches on each spoked wheel, each notch corresponding to a slot on the spoked wheel;

a stop member mounted on the base and biased toward a bottom end of the notches, and wherein the stop member anti notches are configured such that as each spoked wheel rotates a corresponding stop member moves into and out of the notches, and such that when the stop member is at the bottom end of any notch an open end of a slot on the spoked wheel is substantially aligned with the gap;

wherein each notch includes walls sloping toward each other from an outer end of the notch to a bottom end of the notch, wherein the outer ends of the sloped walls substantially intersect such that the stop member bears against the sloped walls and urges the spoked wheel to a position where the stop member is at the bottom end of a notch.

16. The apparatus of claim 1 comprising a front wheel defining a front slot and a rear wheel defining a rear slot, wherein:

in a first position an open end of the front slot is substantially aligned with the gap at a front portion of the gap to receive the selected object and an open end of the rear slot is substantially aligned with the gap at a rear portion of the gap to allow the selected object to move rearward away from the apparatus;

in a second position the open end of the front slot is substantially aligned with the gap at a middle portion of the gap to allow the selected object to move rearward through the gap and an open end of the rear slot is substantially aligned with the gap at the middle portion of the gap adjacent to the open end of the front slot to receive the selected object as it moves rearward out of the open end of the front slot;

the front and rear wheels are linked such that as the front wheel rotates from the first position to the second position in response to the selected object moving rearward in the front slot through the gap the rear wheel rotates from the first position to the second position, and as the selected object enters the rear slot and moves rearward through the gap the front and rear wheels rotate to the first position.

17. The apparatus of claim 16 wherein the front and rear wheels are linked by a tie rod.

18. The apparatus of claim 16 wherein the front band rear wheels are linked by gears defined in outer rims of the front and rear wheels.

19. The apparatus of claim 16 wherein at least one of the front and rear wheels comprises a partial circular portion.

20. The apparatus of claim 1 wherein the inner surfaces of the wheel wells substantially define a circle with a diameter substantially equal to an outside diameter of the wheels.

21. The apparatus of claim 1 wherein the base has a front surface sloping upward and rearward from the front end of the lower surface of the base to the front end of the top surface of the base.

22. The apparatus of claim 21 wherein the base has side surfaces sloping upward and inward from the lower surface of the base to the top surface of the base.

23. The apparatus of claim 1 further comprising a stroke counter operative to count and record each time a selected object passes through the gap.

24. A roping practice apparatus comprising:

a base;

a plurality of spoked wheels rotatably mounted to the base about substantially parallel and horizontal wheel axes oriented transverse to the base and below the top surface of the base;

wherein each spoked wheel defines a slot between adjacent radially extending spokes, and wherein the spoked wheels are mounted such that the spokes extend above a top surface of the base;

a head portion defining a plurality of wheel wells on a bottom surface thereof, and wherein each spoked wheel extends upward into a corresponding wheel well;

a well flange extending laterally from a first sidewall of each wheel well into the corresponding wheel well;

a spoke flange extending laterally from an outer end of each spoke toward the first sidewall of the corresponding wheel well such that the spoke flanges pass above the well flange as the spoked wheels rotate;

wherein the head portion is supported above the base by inner surfaces of the wheel wells bearing against the outer ends of the spokes such that a gap is formed between the bottom surface of the head portion and the top surface of the base; and wherein the spoked wheels are configured such that a rope drawn through the gap enters a slot on each spoked wheel and causes each spoked wheel to rotate.

25. The apparatus of claim 24 wherein the well flanges and spoke flanges are configured such that lower surfaces of the spoke flanges and upper surfaces of the well flanges are arced with a radius having a center located substantially at the wheel axis of the corresponding spoked wheels.

26. The apparatus of claim 24 wherein the well flange in at least one wheel well is retractable such that a corresponding spoked wheel can be removed from the at least one wheel well.

27. The apparatus of claim 24 further comprising a spoked wheel orientation mechanism operative to stop each spoked wheel at a location wherein an open end of a slot on each spoked wheel is substantially aligned with the gap to receive the rope.

28. The apparatus of claim 24 comprising a horn portion mounted above the head portion, the horn portion comprising horn members extending laterally from each side of the horn portion and wherein:

right and left spoked wheels with spoke flanges extend upward from a forward portion of a top surface of the head portion;

corresponding right and left wheel wells with well flange are defined in corresponding forward portions of the horn portion;

a front end of the horn portion is supported above the head portion by an inner surface of the right and left wheel wells bearing against outer ends of the spokes of the right and left spoked wheels such that a gap is formed between forward portions of the bottom surface of the horn portion and the top surface of the head portion, and where a rear portion of the bottom surface of the horn portion rests on a rear portion of the top surface of the head portion; and as a rope moves rearward through the gap to a sloped rear end of the gap the rope causes the rear portion of the horn portion to move upward off the top surface of the head portion to allow the selected object to move rearward and away from the apparatus.

* * * * *

UNITED STATES PATENT AND TRADEMARK OFFICE

CERTIFICATE OF CORRECTION

PATENT NO. : 7,784,793 B2
APPLICATION NO. : 12/197750
DATED : August 31, 2010
INVENTOR(S) : Glen Kemp It is certified that error appears in the above-identified patent and that said Letters Patent is hereby corrected as shown below:

Title Page; item (30); please insert; --a priority claim to CA2598875, having a priority date of August 24, 2007-- should be included.

Column 10, line 34, in claim 7, “tipper” should read “upper”

Column 11, line 32, in claim 15, “anti” should read “and”

Signed and Sealed this
Fifth Day of April, 2011

David J. Kappos

David J. Kappos
*Director of the United States Patent and Trademark Office*